US006354049B1

(12) United States Patent
Bennett

(10) Patent No.: US 6,354,049 B1
(45) Date of Patent: Mar. 12, 2002

(54) CO-EXTRUDED VINYL CORNER GUARD ASSEMBLY

(75) Inventor: Matthew G Bennett, New Berlin, WI (US)

(73) Assignee: Inpro Corporation, Muskego, WI (US)

( * ) Notice: Subject to any disclaimer, the term of this patent is extended or adjusted under 35 U.S.C. 154(b) by 0 days.

(21) Appl. No.: 09/552,902

(22) Filed: Apr. 20, 2000

(51) Int. Cl.[7] ..... E04F 19/02

(52) U.S. Cl. ..... 52/287.1; 52/288.1; 52/717.03; 52/717.04; 52/717.05; 52/718.04

(58) Field of Search ..... 52/287.1, 288.1, 52/255, 716.1, 717.03, 717.04, 717.05, 718.01, 718.04

(56) References Cited

U.S. PATENT DOCUMENTS

| | | | | |
|---|---|---|---|---|
| 3,712,003 A | | 1/1973 | Hallock et al. | |
| 3,717,968 A | | 2/1973 | Olsen et al. | |
| 4,012,878 A | | 3/1977 | Ellingson | |
| 4,104,839 A | * | 8/1978 | Balzer et al. | 52/288.1 |
| 4,161,853 A | * | 7/1979 | Weiss et al. | 52/288.1 |
| 4,430,833 A | | 2/1984 | Balzer et al. | |
| 4,706,426 A | * | 11/1987 | Rumsey | 52/232 |
| 4,708,894 A | * | 11/1987 | Mabuchi et al. | 52/717.04 X |
| 4,903,449 A | | 2/1990 | Ellingson, Jr. | |
| 5,157,886 A | | 10/1992 | Azzar et al. | |
| 5,233,804 A | | 8/1993 | Miller | |
| 5,363,617 A | | 11/1994 | Miller | |
| 5,783,020 A | | 7/1998 | Kress | |
| 6,044,601 A | * | 4/2000 | Chmela et al. | 52/287.1 |
| 6,122,872 A | * | 9/2000 | Sauter | 52/288.1 |

OTHER PUBLICATIONS

150 & 160 High Impace Corner Guards, InPro Corporation, 1999.

* cited by examiner

*Primary Examiner*—Beth Stephan
*Assistant Examiner*—Brian E. Glessner

(57) ABSTRACT

A corner guard assembly for protecting the corner of a building wall particularly in institutional type facilities from damage due to impacts with wheeled vehicles includes a vinyl retainer base plate, a plurality of fasteners for fastening the base plate to the corner of the building wall, a vinyl cover member assembled over the base plate, and endcaps assembled to the upper and lower ends of the assembly. The novel vinyl base plate further includes a rigid main body portion that is applied over the wall surface at the corner combined with a co-extruded flexible impact bumper at the apex of the main body, the impact forces being absorbed by the impact bumper. The geometry of the cover member matches the geometry of the impact bumper to maximize the surface contact area of the two components to further dissipate the impact forces.

13 Claims, 2 Drawing Sheets

CO-EXTRUDED VINYL CORNER GUARD ASSEMBLY

The present invention relates to a corner guard assembly for protecting the corners of walls in institutional facilities. In particular, the invention relates to a corner guard assembly which includes a co-extruded vinyl retainer for the assembly.

DISCUSSION OF THE RELATED ART

In institutional facilities such as hospitals, elderly care centers, and other public buildings, the corner of building walls are exposed to damage from impact resulting from forceful contact with various kinds of wheeled vehicles, such as stretchers, wheelchairs, dining carts and the like. For this reason, the corners of the building wall are commonly provided with a corner guard that will protect the wall surfaces from damage resulting from the impact.

Conventional corner guards are normally comprised of an assembly that includes a metallic base plate, often made of aluminum, which overlays the wall surfaces at the corner, and further includes a resilient cover member that is attached over the base plate. Upon impact, the resilient cover member will deform absorbing the force of the impact. Examples of such conventional corner guard assemblies include the devices disclosed in U.S. Pat. No. 3,717,968 issued to Robert W. Olsen, et al, U.S. Pat. No. 4,430,883 issued to Claude P. Balzer et al, and U.S. Pat. No. 5,363,617 issued to Donald W. Miller.

Comer guard assemblies are, however, occasionally struck with sufficient force to damage the assembly. In fact, if the impact is significant enough, the cover member will be subjected to a double impact, the first impact occurring when the vehicle strikes the cover member, and the second occurring immediately thereafter when the cover member strikes the base plate. Such impacts can cause cracking, breaking, or indentations of the cover member. Severe impacts may result in a bending and disfiguration of the base plate as well. Such damage is very unsightly and produces a negative image of the facility.

Accordingly, an improved corner guard assembly is desired.

SUMMARY OF THE INVENTION

An improved corner guard assembly designed especially for use in institutional type facilities is presented. The corner guard assembly of the present invention includes a vinyl retainer base plate as well as a vinyl cover guard. More specifically, the corner guard assembly presented herein includes a novel vinyl base plate having a rigid main body portion that is applied over the wall surface at the corner combined with a co-extruded flexible impact bumper at the apex of the main body.

The present invention resists exceptionally heavy impact loads without damage or failure to the corner guard assembly. The present invention, which includes the co-extruded vinyl base plate, has been found to be several times stronger than a conventional corner guard assembly using an aluminum retainer base plate. It has also been found to be several times stronger than a corner guard assembly that includes a vinyl base plate but is without the co-extruded impact bumper.

Several other advantages are also achieved. For example, the corner guard assembly disclosed herein is substantially lighter in weight compared to conventional corner guard assemblies that include metallic based plates, which make the present invention substantially lighter than prior designs thereby facilitating easier installation and less expensive shipping. The vinyl base plate allows customers to field bend the corner guard to fit almost any angled corner. The two wall surfaces at the corner don't have to intersect exactly at a right angle. Fastening hardware can be screwed directly into the vinyl retainer and into the wall without pre-drilling or pre-stamping holes, which is required for metallic based plates. The assembly can also be made of 100% recycled plastic.

Other objects and advantages of the invention will become apparent from the following detailed description, which, together with the accompanying drawings, sets forth by way of illustration and example certain preferred embodiments of the present invention.

BRIEF DESCRIPTION OF THE DRAWINGS

The drawings, which constitute a part of this specification and include an exemplary embodiment of the present invention, include the following.

DETAILED DESCRIPTION OF THE PREFERRED EMBODIMENT

Figure 1:
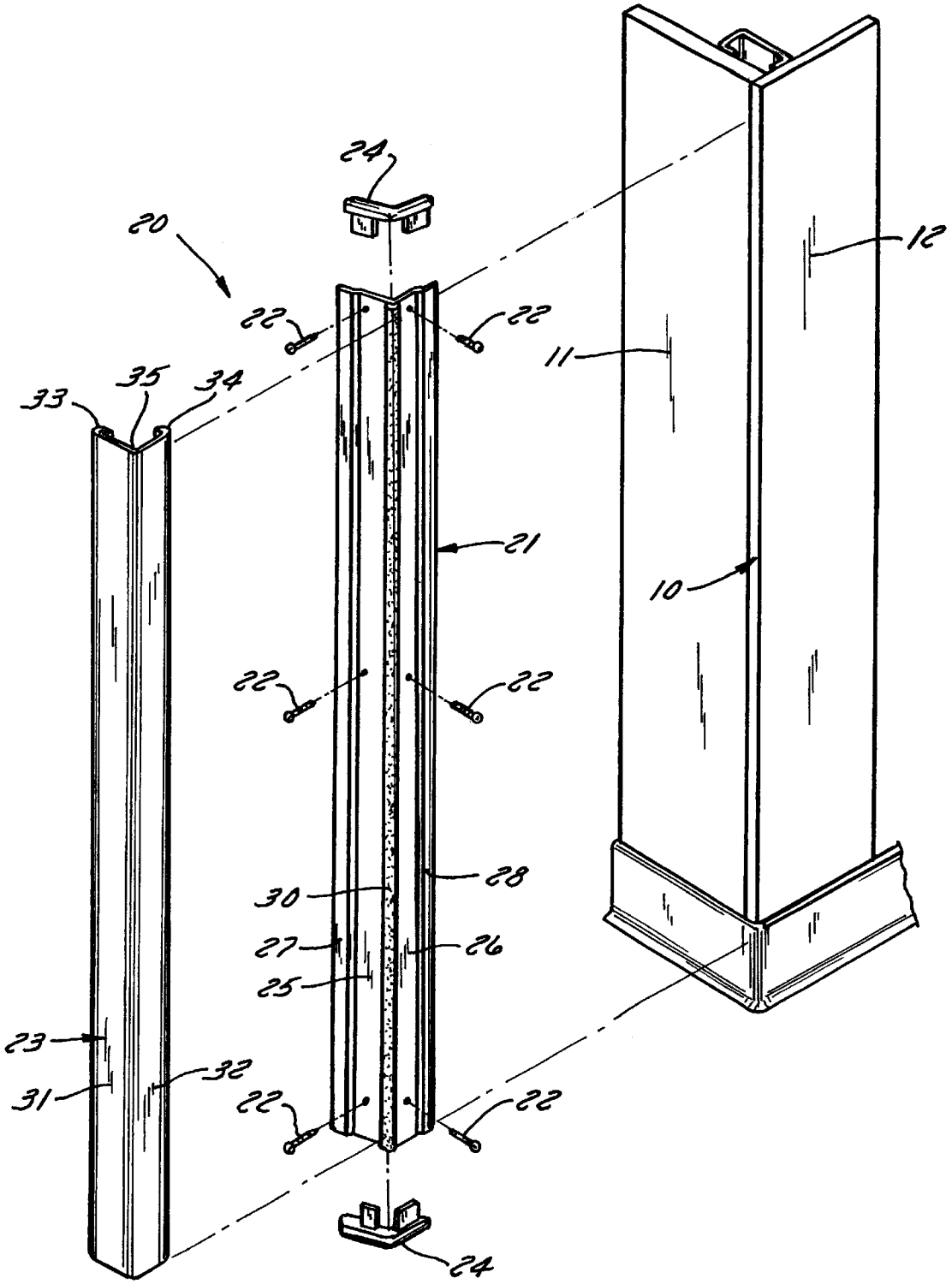
FIG. 1 is an exploded view illustrating the corner guard assembly of the present invention and the manner in which it is assembled to the corner of a building wall.
Figure 2:
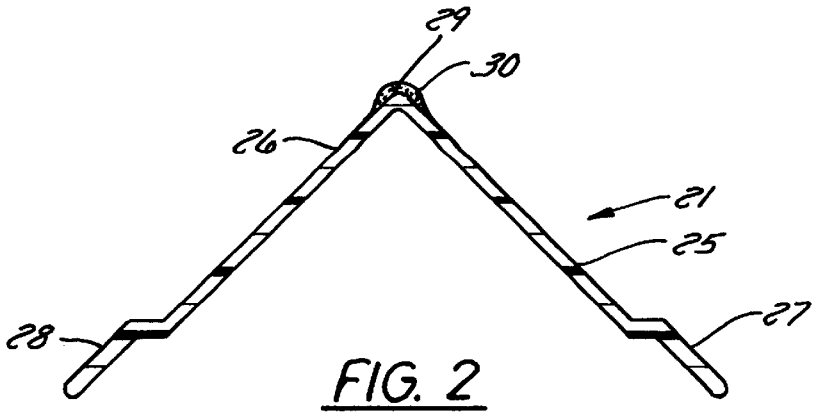
FIG. 2 is a cross-section view of the co-extruded vinyl base plate of the present invention.
Figure 3:
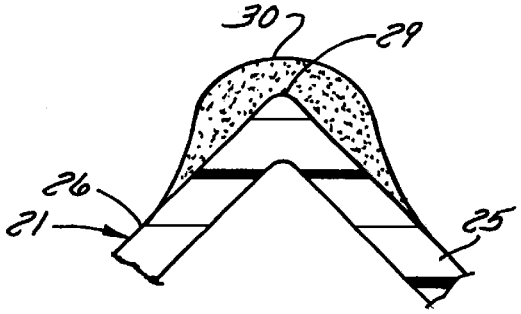
FIG. 3 is an enlarged cross-section view of the co-extruded flexible impact bumper at the apex of the base plate.
Figure 4:
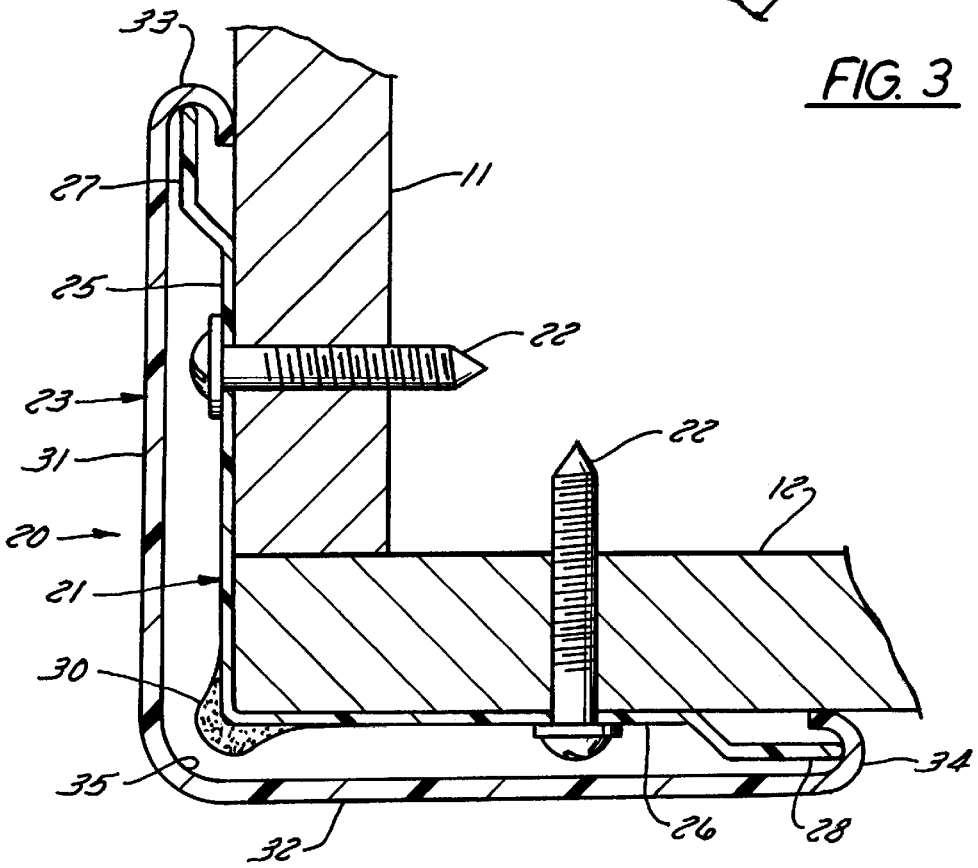
FIG. 4 is a cross section view of the corner guard assembly of the present invention, shown assembled to the corner of a building wall.

Referring to FIGS. 1 and 4, a corner 10 of a building wall is defined by the intersection of two wall surfaces. The corner may be formed by assembling at right angles a first panel 11 and a second panel 12 of drywall, sheetrock, or the like. The walls define hallways and corridors for directing pedestrians and wheeled vehicles such as carts, mobile tables, wheelchairs and the like through the building. Thus the corner is subject to impact from such vehicle striking the corner of the wall with various degrees of force. Accordingly, a corner guard assembly 20 is applied to the corner of the building wall.

Referring again to FIGS. 1 and 4, the present invention of a corner guard assembly 20 is comprised of a retainer member 21, a plurality of fasteners 22 for fastening the retainer member to the corner of the building wall, a corresponding cover member 23 assembled over the retainer member, and endcaps 24 assembled to the upper and lower ends of the assembly.

The retainer member 21 is an elongated member including a first flat planar portion 25 and a second flat planar portion 26, the two flat planar portions each extending the entire length of the retainer member. The first flat planar portion 25 is applied over the first wall surface 11, and the second flat planar portion 26 is applied over the second wall surface 12. The first flat planar portion 25 intersects the second flat planar portion 26 preferably at an angle that corresponds to the angle of intersection of the first and second wall surfaces 11 and 12, which normally should be about 90°. The retainer member 21 is made of a plastic material, preferably an extruded polyvinyl chloride plastic material (PVC). In the construction of building walls, the two intersecting wall surfaces 11 and 12 that form the corner 10 are occasional assembled together in a manner that does not form a precise right angle. In that event, the plastic retainer member 21 may be flexed a slight amount in order to properly fit over the corner of the building wall to which the corner assembly is being applied.

The first flat planar portion 25 has an offset edge portion 27. The second flat planar portion 26 has a similar second offset edge portion 28. When the retainer member 21 is applied to the corner 10 of the wall, the first offset edge portion 27 is raised a slight distance from the surface of the first wall section 11 of the building wall. Likewise, the second offset edge portion 28 is raised a slight distance away from the second wall surface 12. The first and second raised edge portions 27 and 28 form edges around which the cover member 23 is assembled.

As mentioned, the main body portion of the retainer member 21 is fabricated preferably from a rigid PVC material. Rigid polyvinyl chlorides normally have no plasticizes added to the material. One particular grade of material which is known to work satisfactorily is Synergistics Polycor D1015 Natural. The material comes in pellets that are melted and extruded through a die to form the retainer member. The properties of this material include a Shore D hardness scale according to ASTM Standard D2240 of about 80, and a tensile strength according to ASTM Standard D638 of about 6800 psi. Other comparable materials having similar characteristics may be available in the market.

At the apex 29 of the retainer member 21, i.e., at the outer radius of the point where the first flat planar portion 25 intersects the second flat planar portion 26, a co-extruded flexible PVC impact bumper 30 is applied. The impact bumper 30 is similarly fabricated from pellets of raw plastic material that are melted and extruded through a die into the proper form. Preferably, the main body portion and the impact bumper are simultaneously co-extruded so that the impact bumper is applied to the apex of the main body portion of the retainer member while both materials are warm and soft and thus become integrally bonded to each other. The impact bumper 30 is preferably made from a flexible, rather than a rigid, polyvinyl chloride (PVC) material. Flexible polyvinyl chlorides have a plasticiser added to the materials. One known suitable material is Prime Flexible 7082*b* Natural, available from Prime PVC. Characteristics of this particular material include a Shore A durameter according to ASTM Standard D 2240 of about 80, and a tensile strength according to ASTM Standard D638 of about 1720 psi. Other suitable materials may be available in the market.

The retainer member 21 is applied to the corner 10 of the building wall as illustrated in FIG. 1. Because the retainer member 21 is made from a PVC plastic, the first and second flat planar portions 25 and 26 are able to bend a slight amount relative to each other in order to fit the precise angle of the first and second wall surfaces 11 and 12, respectively, of the corner 10 of the building wall. The retainer member 21 is fastened to the corner 10 with a plurality of fasteners 22, preferably self-tapping screws. The screws 22 may be applied virtually anywhere along the length of the retainer member 21. By pressing and rotating a self-tapping screw 22 into the surface of the retainer member 21, the screw 22 will protrude through the plastic material of the retainer member 21 and into the drywall or sheet rock substrate.

The corner guard assembly 20 further includes a cover member 23 that is assembled over the retainer member. The cover member 23 is also preferably fabricated from a vinyl material, preferably of a decorative color, and the exterior surface may be textured or optionally laminated with a decorative film. The cover member 23 is comprised of a first flat portion 31 and a second flat portion 32, the first and second flat portions intersecting at a rounded corner portion 35. The cover members 23 further includes a first inwardly turned, hooked shaped end portion 33 on the edge of the first flat surface 31, which hooks around for engagement to the first raised edge portion 27 of the retainer member 21. Likewise, a second inwardly turned, hooked shaped end portion 34 on the edge of the second flat surface 32 of the cover member 23 hooks around for engagement over the second raised edge portion 28 of the retainer member 21. Being vinyl, the cover member 23 is capable of deforming a slight amount to bend the two hook shaped end portions 33 and 34 apart from each other to fit over the opposing edges 27 and 28 of the retainer member 21, and then return to its original shape. Accordingly, the cover member 23 snaps in place and fits snugly over the retainer member 21.

The cover member 23 fits over the retainer member 21 in a spaced apart relation. In other words, when the cover member 23 is assembled onto the retainer member 21, the interior surface of the cover member 23 is spaced a short distance apart from the outer surface of the retainer member 21. This provides a narrow gap or buffer zone between the two components. Consequently, in the event a wheeled vehicle strikes the corner guard assembly 20, the cover member 23 absorbs and dissipates the initial impact. Only if the impact is significant enough will the cover member 23 be propelled towards and strike against the retainer member 21.

The impact load is further dissipated by the design of the cover member 23 and the retainer member 21, and consequently by the manner in which the inside surface of the cover member strikes the retainer member. Specifically, the inside surface of the rounded corner portion 35 of the cover member 23 defines an inner radius. The co-extruded bumper 30 on the apex of the retainer member 21 is also preferably rounded with an outer radius that corresponds to the inner radius of the corner portion of the cover member. As a result, in the event the cover member 23 is struck with significant force to cause it to strike against the retainer member 21, the inner radius of the corner portion 35 of the cover member will become engaged against the outer radius of the co-extruded impact bumper 30 on the apex of the retainer member. Because the inner radius of the corner portion of the cover member corresponds to the outer radius of the impact bumper, the surface area of engagement between the two surfaces is maximized, thereby spreading the impact force over the maximum possible area of the flexible PVC material of the impact bumper.

Endcaps 24, preferably fabricated from an injection molded Thermoplastic material preferably of the same decorative color as the cover member 23, are applied to the upper and lower ends of the corner guard assembly.

The corner guard assembly disclosed herein has a very desirable aesthetic appearance. Moreover, it performs in accordance with the highest architectural standards and specifications for institutional type facilities, including standards relating to fire protection and flammability, impact strength, chemical and stain resistance, and installation requirements. With respect to impact strength in particular, the present invention has been found to resist impact forces in excess of 150 ft.-lb. with no visible blemishes appearing on the vinyl cover surface and no deformations in the co-extruded vinyl retainer.

Of course, specific structural details disclosed above are not to be interpreted as limiting the scope of the invention, but represented merely as a basis for the claims and for teaching one skilled in the art to employ the present invention in any appropriately detailed structure. Changes may be made in the specific structural details of the particular embodiment disclosed above without departing from the spirit of the invention, especially as defined in the following claims.

What is claimed is:

1. A corner guard assembly for protecting a corner of a building wall from impacts, said corner being defined by the intersection of first and second flat wall surfaces, said corner guard assembly comprising:

a retainer member, said retainer member having an elongated main body portion including a first flat planar portion and a second flat planar portion, said first flat planar portion defining a first mounting surface to be applied over the first wall surface, and said second flat planar portion defining a second mounting surface to be applied over the second wall surface, the first and second flat planar portions of the retainer member intersecting at an apex;

a flexible impact bumper on the apex of the retainer member;

the main body of the retainer member being comprised of a rigid extruded vinyl, and the impact bumper being comprised of a co-extruded flexible vinyl;

a plurality of metallic fasteners for fastening said retainer member to said first and second flat wall surfaces;

a decorative cover member which is assembled over the retainer member, said cover member including a first flat cover portion and a second flat cover portion, the first and second flat cover portions intersecting at a rounded corner portion, the rounded corner portion of the cover member defining an inner radius;

the co-extruded impact bumper on the apex of the retainer member including a rounded outer radius that corresponds to the inner radius of the corner portion of the corner member such that, in the event the cover member is struck with sufficient force to cause the cover member to strike against the retainer member, the inner radius of the rounded corner portion of the cover member will become engaged against the outer radius of the co-extruded impact bumper on the apex of the retainer member.

2. The corner guard assembly according to claim 1, wherein the first flat planar portion of the retainer member intersects the second flat planar portion at an angle, and the first flat planar portion is deformable relative to the second flat planar portion so that the angle of intersection of the first and second flat planar portions matches the angle of intersection of the first and second wall surfaces.

3. The corner guard assembly according to claim 2, wherein the first flat planar portion of the retainer member further includes a first offset edge portion and the second flat planar portion further includes a second offset edge portion such that when the retainer member is applied to the corner of the wall the first offset edge portion is raised a slight distance from the first flat wall surface and the second offset edge portion is raised a slight distance away from the second flat wall surface.

4. The corner guard assembly according to claim 3, wherein the first flat cover portion of the cover member further includes a first inwardly turned, hooked shaped end portion that hooks around for engagement to the first offset edge portion of the retainer member, and the second flat cover portion further includes a second inwardly turned, hooked shaped end portion that hooks around for engagement to the second offset edge portion of the retainer member.

5. The corner guard assembly according to claim 4, wherein the cover member engages over the offset edge portions of the retainer member in a spaced apart relation such that, when assembled, an inner surface of the cover member is spaced apart a short distance from an outer surface of the retainer member.

6. The corner guard assembly according to claim 5, further comprising end caps applied to upper and lower ends of the corner guard assembly.

7. The corner guard assembly according to claim 1, wherein the main body portion of the retainer member being comprised of a rigid polyvinyl chloride material.

8. The corner guard assembly according to claim 7, wherein the rigid polyvinyl chloride material has a Shore D hardness value according to ASTM Standard D2240 of about 80, and a tensile strength according to ASTM Standard D638 of about 6800 psi.

9. The corner guard assembly according to claim 8, wherein said impact bumper is comprised of a flexible polyvinyl chloride material.

10. The corner guard assembly according to claim 9, wherein the flexible polyvinyl chloride material has a Shore A hardness value according to ASTM Standard D2240 of about 80, and a tensile strength according to ASTM Standard D638 of about 1720 psi.

11. A corner guard assembly for protecting a corner of a building wall from impacts, said corner being defined by a first flat wall section intersecting at an angle relative to a second flat wall section, the first and second flat wall surfaces extending substantially from a floor to a ceiling of the building, said corner guard assembly comprising:

a retainer member, said retainer member having an elongated main body portion that includes a first flat planar portion and a second flat planar portion, said first flat planar portion defining a first mounting surface to be applied over the first wall surface, and said second flat planar portion defining a second mounting surface to be applied over the second wall surface, the first flat planar portion intersecting the second flat planar portion at an angle substantially corresponding to the angle of intersection of the first and second flat wall surfaces, the first flat planar portion further including a first offset edge portion and the second flat planar portion further including a second offset edge portion such that when the retainer member is applied to the corner of the wall the first offset edge portion is raised a slight distance from the first flat wall surface and the second offset edge portion is raised a slight distance away from the second flat wall surface;

the intersection of the first and second flat planar portions of the main body portion of the retainer member defining an apex having a co-extruded bumper thereon;

a plurality of metallic fasteners for fastening said retainer member to said first and second flat wall surfaces;

a decorative cover member assembled over the retainer member, said cover member including a first flat cover portion and a second flat cover portion, the first and second flat cover portions intersecting at a rounded corner portion; the first flat cover portion further including a first inwardly turned, hooked shaped end portion that hooks around for engagement to the first offset edge portion of the retainer member, and the second flat cover portion including a second inwardly turned, hooked shaped end portion that hooks around for engagement to the second offset edge portion of the retainer member, the cover member fitting over the retainer member in a spaced apart relation such that, when assembled, an inner surface of the cover member is spaced apart a short distance from an outer surface of the retainer member;

the rounded corner portion of the cover member defining an inner radius;

the co-extruded bumper on the apex of the retainer member including a rounded outer radius that corresponds to the inner radius of the corner portion of the corner member such that, in the event the cover member is struck with sufficient force to cause the cover member to strike against the retainer member, the inner radius of the rounded corner portion of the cover member will become engaged against the outer radius of the co-extruded bumper on the apex of the retainer member;

the retainer member being comprised of co-extruded vinyl materials comprised of a rigid polyvinyl chloride forming the main body portion and a flexible polyvinyl chloride forming the co-extruded bumper on the apex thereof; and, end caps applied to upper and lower ends of the corner guard assembly.

12. The corner guard assembly according to claim 11, wherein the rigid polyvinyl chloride material forming the main body portion of the retainer member has a Shore D hardness value according to ASTM Standard D2240 of about 80, and a tensile strength according to ASTM Standard D638 of about 6800 psi.

13. The corner guard assembly according to claim 12, wherein the flexible polyvinyl chloride material forming the co-extruded bumper of the retainer member has Shore A hardness value according to ASTM Standard D 2240 of about 80, and a tensile strength according to ASTM Standard D638 of about 1720 psi.

* * * * *